US010047572B2

(12) United States Patent
Back

(10) Patent No.: US 10,047,572 B2
(45) Date of Patent: Aug. 14, 2018

(54) OVERSHOT TOOL HAVING LATCH CONTROL MEANS

(71) Applicant: SANDVIK INTELLECTUAL PROPERTY AB, Sandviken (SE)

(72) Inventor: Goran Back, Nora (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 293 days.

(21) Appl. No.: 14/771,801

(22) PCT Filed: Feb. 11, 2014

(86) PCT No.: PCT/EP2014/052636

§ 371 (c)(1),
(2) Date: Aug. 31, 2015

(87) PCT Pub. No.: WO2014/131614

PCT Pub. Date: Sep. 4, 2014

(65) Prior Publication Data

US 2016/0017672 A1 Jan. 21, 2016

(30) Foreign Application Priority Data

Mar. 1, 2013 (AU) ..... 2013900702

(51) Int. Cl.
*E21B 17/046* (2006.01)
*E21B 23/00* (2006.01)
*E21B 25/02* (2006.01)

(52) U.S. Cl.
CPC ..... *E21B 17/046* (2013.01); *E21B 23/006* (2013.01); *E21B 25/02* (2013.01)

(58) Field of Classification Search
CPC ..... E21B 17/046; E21B 23/006; E21B 25/02
See application file for complete search history.

(56) References Cited

U.S. PATENT DOCUMENTS 2,018,414 A * 10/1935 Oksenholt ..... E21B 25/02 175/236
2,245,571 A * 6/1941 Chappell ..... E21B 23/06 294/86.18
2,250,463 A 7/1941 Boynton
(Continued)

FOREIGN PATENT DOCUMENTS

EP 049698 A2 4/1982
EP 050104 A2 4/1982
(Continued)

OTHER PUBLICATIONS

M-Concept 3D Animation Project: NSU Core Barre System Sandvik, Sep. 8, 2014.YouTube.
Wireline core barrel NEW latching system, www.sandvik.com.

*Primary Examiner* — Matthew R Buck
(74) *Attorney, Agent, or Firm* — Corinne R. Gorski

(57) ABSTRACT

An overshot tool for releasable connection to a head assembly as part of a core barrel drilling apparatus. The overshot tool comprises a primary engaging portion and a secondary engaging portion and is configured for the automated coupling and de-coupling to a head assembly via selected engagement of the head assembly by the engaging portion. The overshot tool is configured to both deliver and retrieve a head assembly from a latched position at a cutting end the core barrel.

13 Claims, 16 Drawing Sheets

(56) References Cited

U.S. PATENT DOCUMENTS

| | | | | | |
|---|---|---|---|---|---|
| 3,610,675 | A * | 10/1971 | Jensen | E21B 23/02 294/86.19 |
| 3,977,482 | A | 8/1976 | Reed et al. | |
| 4,101,157 | A * | 7/1978 | Richey | E21B 23/006 166/240 |
| 4,232,894 | A * | 11/1980 | Taylor | E21B 31/18 294/86.21 |
| 5,242,201 | A * | 9/1993 | Beeman | E21B 23/04 294/86.15 |
| 5,580,114 | A * | 12/1996 | Palmer | E21B 23/04 294/86.15 |
| 5,791,712 | A * | 8/1998 | Hawn | E21B 31/18 294/86.15 |
| 5,947,202 | A * | 9/1999 | Gazewood | E21B 31/20 166/301 |
| 6,029,758 | A | 2/2000 | Novacovicci et al. | |
| 6,089,335 | A | 7/2000 | Able | |
| 6,095,583 | A * | 8/2000 | Beeman | E21B 31/18 294/86.15 |
| 6,827,148 | B2 * | 12/2004 | Shaw | E21B 10/322 166/255.1 |
| 9,322,220 | B2 * | 4/2016 | Innes | E21B 7/124 |
| 9,695,658 | B2 * | 7/2017 | Hallundbæk | E21B 23/04 |
| 2009/0242203 | A1 * | 10/2009 | Pardey | E21B 31/18 166/301 |

FOREIGN PATENT DOCUMENTS

| | | |
|---|---|---|
| GB | 1478127 | 6/1977 |
| RU | 2302509 C2 | 7/2001 |
| SU | 861551 A1 | 9/1981 |
| WO | 2012119186 A1 | 9/2012 |

* cited by examiner

OVERSHOT TOOL HAVING LATCH CONTROL MEANS

RELATED APPLICATION DATA

This application is a § 371 National Stage Application of PCT International Application No. PCT/EP2014/052636 filed Feb. 11, 2014 claiming priority of AU Application No. 2013900702, filed Mar. 1, 2013.

FIELD OF INVENTION

The present invention relates to an overshot tool having means for engaging and disengaging a latch in a core barrel head assembly used in core drilling operations and in particular although not exclusively to an overshot tool having an automated latching control mechanism to allow automated coupling and retrieval of the head assembly from within a bore hole.

BACKGROUND ART

Diamond core drilling utilises an annular drill bit connected to a core barrel assembly. The core barrel is attached to the end of a number of tubular drill rods connected to form a drill string. The drilling progressively removes cylindrical cores of rock or material through which the drill and drill tube advance using a sequence of runs. This type of drilling utilises an inner tube assembly which has an inner tube connected to a head assembly to receive the core sample. The head assembly comprises a latch body connected to a valve housing which in turn is connected to a bearing housing which in turn is connected to an inner tube connector. The inner tube assembly connects to the inner tube connector and may comprise an inner tube, core lifter and core lift case. The inner tube assembly locates within a core barrel which comprises a combination of drill bit, reamer, outer tube, landing ring and locking coupling. The inner tube assembly can be retrieved from the surface when the inner tube is full. Empty inner tube assemblies can be delivered from the surface to the bottom of the drill string in order to recommence drilling.

The drill bit is advanced by rotating the drill string while applying downward pressure. In addition, drilling fluid such as water or drilling muds are pumped through the centre of the drill string, past the inner tube assembly and through the end of the drill bit in order to carry cuttings and other drilling debris to the surface via the annulus between the wall of the hole and the external surface of the drill string.

The hole being drilled may range from vertical, angled downwardly, horizontal, inclined upwardly or directly upwardly. The holes being drilled may be either normal or dry. In dry holes, the drilling fluid drains away or partially drains away naturally through crevasses or other openings in the rock strata through which the drill passes. In normal holes, the drilling fluid does not drain away.

Hereafter, normal holes, which retain water or partially retain water will be referred to as wet holes.

Of course, in the case of horizontal or near horizontal holes, it is likely that drilling fluid would naturally drain away particularly when the inner tube assembly is being retrieved or after the inner tube assembly is pumped back into the end of the drill string.

With either locating an inner tube assembly within a drill string or retrieving an inner tube assembly, when the inner tube is full, it is most often the case that an overshot tool is used to either lower the inner tube assembly into place, be used to pump the inner tube assembly into place or be lowered by itself to retrieve the inner tube assembly. In the case of a dry hole, the overshot tool will hold the inner tube assembly and their combined weight will allow the inner tube assembly to be lowered into position. In the case of a wet hole, or where the hole is partially wet or where the hole is horizontal, inclined upwardly or upwardly vertical, then the overshot tool has a sealing section which is fluid tight and enables fluid pressure to push the overshot tool and the attached inner tube assembly along the drill tubing.

The overshot tool, when used to retrieve an inner tube assembly when the inner tube assembly is full, can either fall under gravity to latch with the core barrel assembly or again be pumped into place to latch with the core barrel assembly.

A conventional latch in an inner tube assembly of a smaller diameter comprises a pair of pivoted and opposed arms. The lower portions below the pivot point of the arms have a resilient or biasing means which draw the lower ends together. This in turn causes the upper ends of the latch members to project outwardly from the inner tube assembly. In this position they can engage with a locking coupling included in the core barrel to latch the inner tube assembly with respect to the core barrel.

The overshot tool needs to cooperate with this latch so that the inner tube assembly can be held with respect to the overshot tool when it is being placed into position within the drill string and core barrel or alternatively must cooperate with the latch when the overshot tool is being used to retrieve the inner tube assembly.

In the case of retrieval, the overshot tool needs to engage the latch so that it releases the inner core assembly from the core barrel while at the same time the latch also needs to engage the overshot tool so that the overshot tool is held by the core barrel latch which allows for withdrawal of the inner tube assembly from the drill tube.

Once the retrieved inner tube assembly is at the surface, the latch needs to be easily disengaged from the overshot tool.

Various means exist for performing all of the above functions. However, it is the case that there are a number of different pieces of equipment that are used depending on the type of hole being drilled. The hole may be wet or dry and it may be vertically down or vertically up or any inclination in between. This means that the set of equipment, being the inner tube assembly and overshot tools differ in their configuration and operation depending on the type of hole being drilled.

It is against this background and the properties and difficulties associated therewith that the present invention has been developed.

Certain objects and advantages of the present invention will become apparent from the following description taking in connection with the accompanying drawings, wherein, by way of illustration and example, and embodiment of the present invention it is disclosed.

SUMMARY OF THE INVENTION

It is an objective of the present invention to provide an overshot tool configured to cooperate with a latch mechanism of a head assembly via an automatic coupling/decoupling engagement such that the tool may be coupled to the head assembly and both components retrieved from the borehole quickly, conveniently and reliably. It is a further specific objective to provide an arrangement that provides both automated and manual decoupling of the tool from the head assembly to allow detachment by personnel at the surface and decoupling down the hole when the overshot tool is used to deliver the head assembly into the final latched position at the cutting end of the core barrel apparatus.

It is a further specific objective to provide an overshot tool that is sensitive to the method of delivery down the borehole so as to provide a feedback signal to an operator that the tool has reached its desired destination at the head assembly. It is a further specific objective to provide an overshot tool that is resistant to decoupling from the head assembly when used to deliver the head assembly into position should the assembly encounter obstructions during delivery.

The automated coupling and decoupling function of the present overshot tool is provided by primary and secondary engaging portions where at least one of the engaging portions is controlled by a latch control that is responsive to the environment in which the tool is placed and additionally the forces acting on the tool. Accordingly, the latch control is configured to control an axial and optionally a rotational movement of the primary and secondary engaging portions. The coupling and decoupling is achieved specifically via engagement by the primary engaging portion (to provide coupling) and the secondary engaging portion (to provide decoupling). The specific activation of the secondary engaging portion is controlled by the latch control and is responsive to forces acting on the tool at the cutting end of the borehole where the head assembly is maintained or released at its latched position against the inner surface of the core barrel. Additionally, the specific objectives are achieved by providing a latch control that is conveniently implemented as a pin and slot arrangement acted on by a bias member that is configured to provide from either an axially forward or rearward end.

According to a first aspect of the present invention there is provided an overshot tool for releasable connection to a head assembly of a core barrel drilling apparatus, the tool comprising: a primary engaging portion to engage a latch of a head assembly to provide an axial couple between the tool and the head assembly; a secondary engaging portion to temporarily engage the latch in addition to the engagement of the latch by the primary engaging portion; a retainer acting between the primary engaging portion and the secondary engaging portion; a housing having a region for engagement by the retainer, the primary engaging portion and the secondary engaging portion axially movable relative to the housing, the retainer configured i) to engage a first part of the region to releasably couple the primary and secondary engaging portions for combined axial movement and ii) to engage a second part of the region to allow at least partial independent axial movement of the secondary engaging portion relative to the primary engaging portion; a bias member acting between the housing and the secondary engaging portion to bias the secondary engaging portion axially relative to the primary engaging portion; wherein by adjustment of a position of the retainer between the first part and the second part of the housing the tool is adjustable between a first mode to allow axial coupling between the tool and the head assembly and a second mode to provide a decoupling of the tool from the head assembly.

Preferably, the primary engaging portion comprises an elongate shaft and the secondary engaging portion comprises a sleeve positioned around the shaft, the sleeve configured to slide axially over the shaft. The elongate shaft comprises an axially forwardmost end that represents an axially forwardmost part of the tool and is configured specifically to engage the latch of the head assembly.

Preferably, the housing comprises a slot in which the first and second parts of the housing comprise regions of the slot and the retainer is capable of movement within the slot between the first and second parts. Preferably, the bias member is configured to bias the secondary engaging portion rotatably relative to the primary engaging portion. Preferably, the bias member is a coil spring extending between the housing and the secondary engaging portion. Such an arrangement is advantageous to provide a reliable and robust configuration for the latch control mechanism that provides the automated or semi-automated latching of the secondary engaging portion and hence a coupling and decoupling action of the tool.

Preferably, the tool further comprises a cover member to accommodate the primary and the secondary engaging portions and the housing wherein the primary and secondary engaging portions and the housing are capable of sliding axially within the cover member. The cover member acts to protect the inner components of the tool and to allow the various components to slide axially and rotate circumferentially around the axis in use.

Optionally, the tool further comprises a temporary rotational lock having at least two locking positions to temporarily lock the housing at the cover member at two rotational positions. The rotational lock is configured to provide quantised default positions of the secondary engaging portion relative to the housing and the primary engaging portion. Accordingly, a degree of force is required to adjust the releasable lock between the two positions so as to change the state of the tool to be configured for latching or unlatching of the head assembly. Such force may be provided by the pressure of a supply fluid or the weight of a free fall delivery assembly acting on the overshot tool.

Preferably, the cover member comprises a cut-out positionable at the same axial and rotational position as the slot of the housing. The cut-out is configured to allow the pin of the latching mechanism to project through the wall of the cover member such that the cover member does not obstruct the latching mechanism and in particular the pin that extends radially outward from the primary engaging portion.

Preferably, the retainer is fixed to and projects radially from the shaft and through the slot in the housing wherein the bias member is configured to force rotational and axial movement of the retainer within the slot. Accordingly, the retainer forms a radially extending region of the shaft such that rotational and axial adjustment of the retainer provides a corresponding movement of the shaft relative to the other components of the tool. The relative position of the shaft is therefore determined by the relative position of the retainer within the various slots and channels of the present overshot tool.

Preferably, the first part at the slot extends in a circumferential direction to receive the retainer and the second part at the slot comprises an axially extending length section being greater than a length section of the first part. Accordingly, the retainer is configured to travel circumferentially and axially within the slot.

Optionally, an engaging end of the primary engaging portion comprises a bayonet configuration at a leading end of the tool being engagable with the latch; and an engaging end of the secondary engaging portion comprises a bell portion to engage the bayonet configuration in touching or near touching contact and release the bayonet configuration from engagement with the latch. Such an arrangement is advantageous to engage a particular configuration of latch at the head assembly that may comprise resiliently biases latching arms having engaging ends movable radially inward and outward.

Preferably, the housing of the tool comprises a coupling portion at a trailing end of the tool to mate with a valve housing or a free fall overshot attachment, the coupling portion capable of sliding axially within the housing and independently of an axial movement of the primary engaging portion. The present tool therefore is configured to mate with an overshot attachment or a valve housing to allow the tool to be both delivered and extracted from the borehole when coupled or decoupled from the head assembly. The latch control of the tool is configured to be sensitive to the coupling state of the valve housing or overshot attachment at the tool to both provide a feedback signal to an operator at surface level and to change the coupling state of the tool to either couple or decouple at the head assembly.

Preferably, the shaft comprises a channel recessed into a radially outward facing surface of the shaft, the channel having a first part aligned axially with the shaft and a second part extending circumferentially around the shaft, a radially inner part of the retainer configured for slidable engagement within the first and second parts of the channel. The channel in cooperative engagement with the retainer acts to restrict relative movement of the shaft both in an axial and rotational direction. Accordingly, the second engaging portion and the primary engaging portion are configured to move relative to one another by a limited range of movement both in the axial and circumferential or rotational directions via various slots and channels as described herein.

According to a second aspect of the present invention there is provided a method of core drilling using a tool forming part of a core barrel drilling apparatus, the method comprising: transporting an overshot tool in an axially forward direction through a core barrel apparatus; engaging a latch of a head assembly via a primary engaging portion of the tool to decouple the head assembly from fixed axial position at the core barrel apparatus and to axially couple the tool to the head assembly; transporting the coupled tool and the head assembly in an axially rearward direction through the core barrel apparatus to retrieve the head assembly, wherein the tool comprises: a primary engaging portion to engage the latch of the head assembly to provide the axial couple between the tool and the head assembly; a second engaging portion to temporarily engage the latch in addition to the engagement of the latch by the primary engaging portion; a retainer acting between the primary engaging portion and the secondary engaging portion; a housing having a region for engagement by the retainer, the primary engaging portion and the secondary engaging portion axially movable relative to the housing and the retainer configured to engage a first part of the region to releasably couple the primary and secondary engaging portions for combined axial movement and the retainer configured to engage a second part of the region to allow at least partial independent axial movement of the secondary engaging portion relative to the primary engaging portion; a bias member acting between the housing and the secondary engaging portion to bias the secondary engaging portion axially relative to the primary engaging portion; wherein by adjustment of a position of the retainer between the first part and the second part of the housing the tool is adjustable between a first mode to allow axial coupling between the tool and the head assembly and a second mode to provide a decoupling of the tool from the head assembly.

Optionally, the method may further comprise a release of the axial couple between the tool and the head assembly by moving axially the secondary engaging portion to contact the latch and releasing engagement between the primary engaging portion and the latch.

In one embodiment, the overshot tool has a first means for engaging a latch in a head assembly, the latch locking to the first means when engaged, and latch control means associated with the first means which is movable with respect of the first means wherein, in a first position, the latch control means allows the first means to engage the latch, and in a second position, the latch control means opens the latch to release the first means from the latch.

The first means on the overshot tool may comprise a number of different arrangements for connecting to the latch in the head assembly. Preferably the first means may comprise a spike which locates into and engages with the latch in the head assembly. Other arrangements may be suited to the first means and will depend on the type of latch used in the head assembly. For the sake of clarity, the first means will be described in the remainder of the specification as comprising a spike, however it will be realised that the invention is not to be restricted to this particular feature.

The latch may comprise a conventional dual arm latch where each arm is diametrically opposed to the other and pivotally secured with respect to the head assembly. However, other latch arrangements such as three of more latch arms or an alternative style of latch would be equally suited to this invention. For example, 4 or 6 arms may be used with larger diameter drilling systems.

In preference, the latch comprises at least two opposed and pivoted latch arms having inner ends that are biased towards one another to push the upper ends outwardly to abut with a locking coupling in a core barrel. The biasing means may comprise an elastomeric member located around the inner ends of the latch arms which acts to draw them together. This in turn causes the outer ends to pivot outwardly with respect to the head assembly.

The spike preferably has a tip that is shaped to that it will pass through the centre of the latch assembly so that the latch moves to allow the tip portion to pass through and, once the tip portion has passed the ends of the latch, the latch arms then closed behind the tip portion to thereby retainably engage the spike. In this position, with the latch engaged on the spike, the upper ends of the latch arms are withdrawn inwardly towards the head assembly so that they will disengage from the locking coupling and allow the inner tube assembly to move within the drill tube. This therefore allows the overshot tool to either retrieve an inner tube assembly by unlocking the latch from the locking coupling or lower the inner tube assembly into the drill tube by having the upper ends of the latch arms withdrawn from their latching position.

There will be a number of different circumstances where the spike is to be disengaged from the latch. It will need to occur at the surface when the inner tube assembly is manually removed from the end of the drill tubing or it will need to occur remotely once the inner tube assembly has landed at the end of the drilling tube which is known as a dry release. It may also need to occur when the inner tube assembly is part way into the hole.

In all cases, the latch control means operates to disengage the latch from the spike to thereby allow separation of the overshot tool from the inner tube assembly. In the case of when the overshot tool is delivering the inner tube assembly to the end of the drill string, this must be achieved remotely and at the surface, the manual disengagement must allow for easy and safe disengagement.

Preferably, the movement of the latch control means can be initiated remotely from the surface. When the overshot tool is returned to the surface it can be operated manually in a manner that is quick and convenient for an operator and does not involve any potential for injury to be caused or for any loss of or damage to the inner tube assembly.

The latch control mean means preferably slides along the outer surface of the spike and further, preferably comprises a sleeve journalled for sliding movement along a shaft of the spike. The end of the latch control means preferably engages with the arms of the latch to open the lower ends of the latch arms against the resilient biasing member to thereby allow the tip of the spike to be withdrawn from the latch.

The latch control means may have an arrangement that allows manual positioning at the surface to control movement of the latch control means. This may comprise a retainer which moves within the control slot to control movement of the latch control means in a predetermined way. For example, this allows for remote release of the latch control means so that it can move to a second position where the spike is disengaged from the latch in the head assembly.

Movement of the latch control means may be under the influence of a spring member that provides at least a compressive load to the latch control means. Movement of the latch control means may be further controlled by a retainer that can be moved to a released position to thereby allow the latch control means to move along the spike to a position where it will release the latch. The retainer can be designed so that it can be selectively released either once the inner tube assembly is located at the end of the drill string to provide remote release or when the inner tube assembly is retrieved to the top of the drill tube.

Preferably, the latch control means has an intermediate position between the first and second positions where the latch control means acts to prevent the latch from opening to thereby inadvertently release the spike. Preferably, the latch control means is provided with an abutment surface that locates adjacent the upper ends of the latch arms that thereby prevent inward movement of the upper ends of the latch arms. By preventing this inward movement, the latch cannot be released from the spike.

Further, the abutment surface, when the latch control means moves to its second position, locates within an area where there is sufficient clearance between the upper ends of the latch arm and the abutment surface to allow movement of the upper ends of the latch arms inwardly to thereby release the forward ends of the latch arms from the spike.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
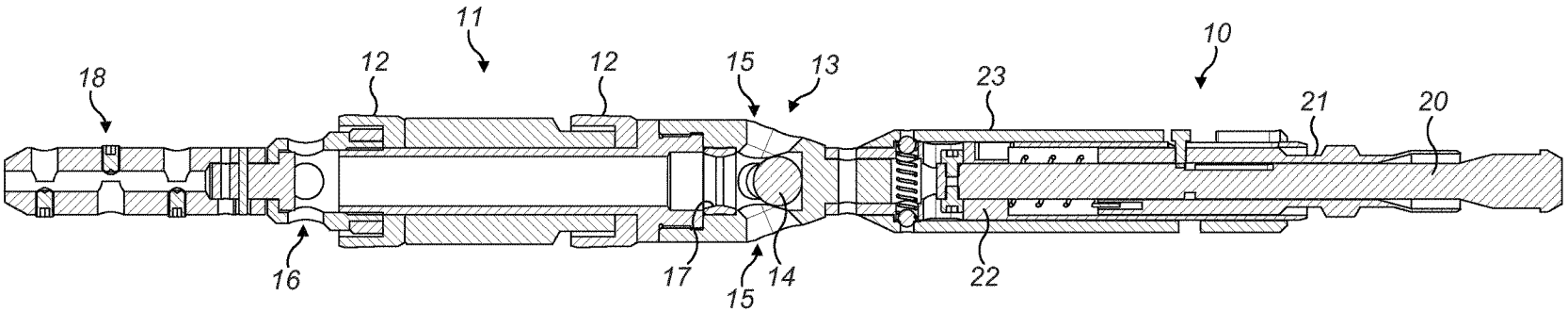
FIG. 1 shows a cross-section view of an overshot assembly comprising an overshot tool and a valve housing.

FIG. 1 shows an overshot assembly which is an assembly of an overshot tool 10 and valve housing 11. The overshot tool 10 is used to retrieve an inner tube assembly. It can also be used to deliver an inner tube assembly to the end of a drill string. The valve housing 11 can be used to pump the overshot tool 10 through a drill string. This will normally be to retrieve the inner tube assembly. The valve housing 11 is provided with seals 12 which provide flexible fluid seals between the valve housing 11 and the inner wall of the drill tube. An indicator valve 13 is provided within the valve housing 11 to provide an indication to the driller when movement of the valve housing 11 ceases. The indicator valve 13 is shown in FIG. 1 in its open position and comprises a ball 14 and fluid flow ports 15. In its open position, the indicator valve allows fluid that is pumped in behind the valve housing 11 to flow through opening 16 and the fluid flow ports 15. In its closed position and in order to pump the valve housing 11 along drill tubing, the ball 14 is set behind valve seat 17 which prevents fluid flow through the valve housing 11 and therefore enables fluid pressure to move the valve housing 11 along the drill tube (as shown in FIG. 3*a*).

Figure 3A:
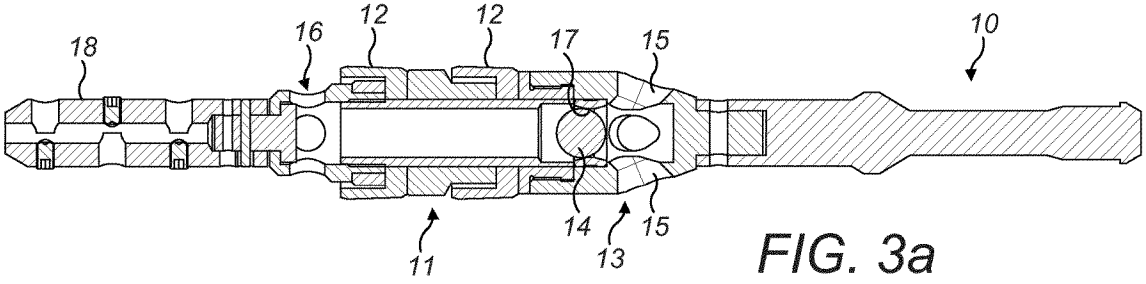
FIGS. 3*a*, 3*b* and 3*c* show cross-section views of a valve housing.

Upon the valve housing 11 becoming stationary as would be the case when the overshot tool 10 engages an inner tube assembly, an increase in fluid pressure will cause the ball 14 to move through the valve seat 17 from the position of FIG. 3*a* to its position of FIG. 1 so that the fluid ports 15 are now open and allow fluid to freely flow forward of the valve housing 11 and around the overshot tool 10. This change in pressure provides an indication at the surface to the drill operator that the overshot tool 10 has landed. The valve housing 11 has a wire rope connector 18 to which a retrieval wire rope is secured. This enables the overshot tool 10 and valve housing 11 combination to withdraw an inner tube assembly from the drill hole. The valve housing 11 is secured to the overshot tool 10 either threadably or by a pin or both. The overshot tool 10 comprises a spike 20 and a latch control means 21. The latch control means 21 has an axial bore through which a portion of the shaft of the spike 20 locates. The spike 20 and latch control means 21 are located within a housing 22 and the housing 22 is in turn located within a cover member 23.

Figure 8:
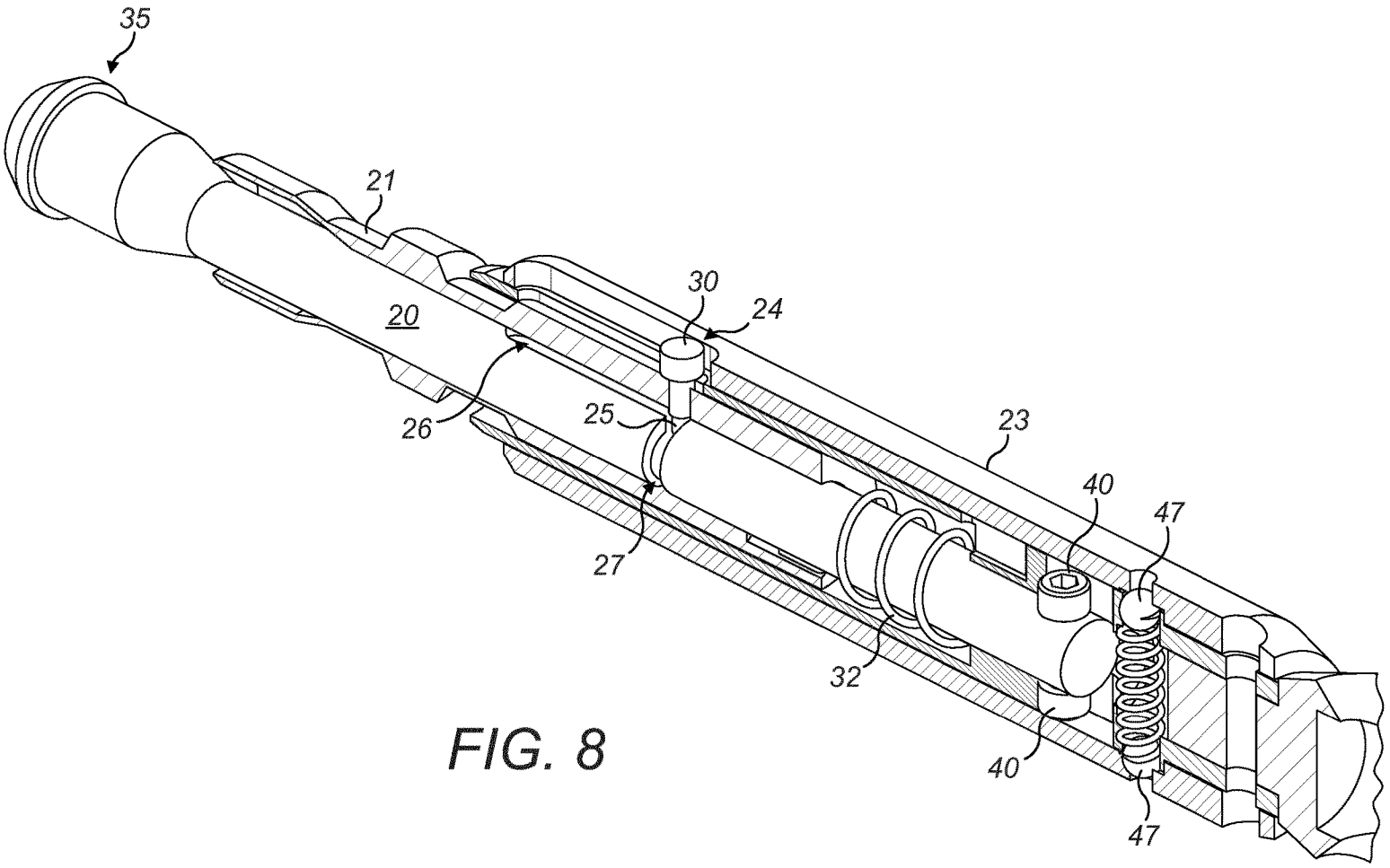
FIG. 8 shows a part cross-section perspective view of the overshot tool, FIG. 9 show a part perspective view of an overshot tool and in particular shows details of the retainer mechanism.

The latch control means 21 comprises a sleeve within which a portion of the shaft of spike 20 is slidably journalled. As will be explained below, the latch control means 21 moves to various positions along the spike 20 to control operation of a latch, and that movement is controlled by a retainer 24 which is threadably mounted with respect to the latch control means 21. An end 25 of the retainer 24 projects from the inner bore of the latch control mean 21 and is selectively locatable within either a longitudinal slot 26 or circumferential slot 27 which are both located on the spike 20 as shown in FIG. 8. The shaft of the retainer 24 locates within a control slot 29 which is located within the wall of the housing 22. The head 30 of the retainer 24 projects above the outer surface of the housing 22 and locates generally within a cut out 31 within the cover member 23. As will be explained below, the head 30 will in certain circumstances abut against an edge of the cut out 31.

A spring 32 is connected to both the housing 22 and the latch control means 21. It provides both a compressive and torsional force to the latch control means 21. The spring 32 is compressed and normally provides a force that pushes the latch control means 21 away from the housing 22. The spike 20 has a tip 35 that comprises a conical portion 36 and a circumferential ledge 37. The conical portion 36 and ledge 37 are designed to engage with the latch in the inner tube assembly.

Figure 2:
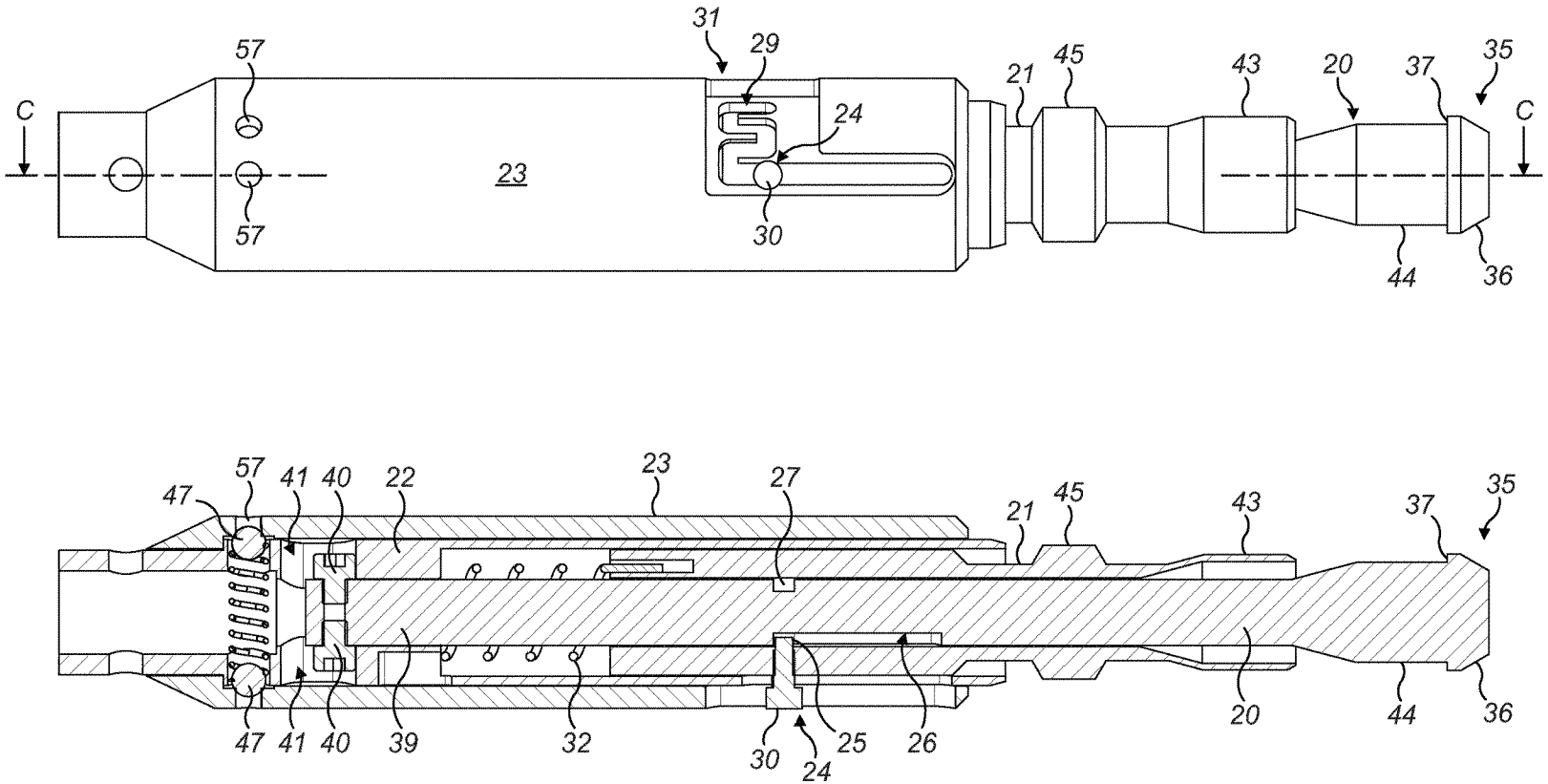
FIG. 2 shows a longitudinal and cross-section view of an overshot tool.

The spike 20 is journalled for sliding movement within a bearing 39 in the housing 22. The spike 20 is retained within the housing 22 via a pair of bolts 40 that threadably engage the end of the spike 20. The heads of the bolts 40 are located within slots 41 which in turn allows a small amount of longitudinal movement of the spike 20 with respect to the housing 22. When the end 25 of the retainer 24 is located within the circumferential slot 27 on the shaft of the spike 20 then the spring 32 acting on the latch control means 21 will in turn bias the spike 20 into its forward position shown in FIG. 2. When the end 25 of the retainer 24 is located within the longitudinal slot 26 on the spike 20, the spring 32 will push the latch control means 21 forward so that the bell portion 43 locates over the head portion 44 of the spike 20. The latch control means 21 has an abutment collar 45 which cooperates with the latch in the head assembly and its operation is described below.

The cover member 23 is journalled for rotation on the housing 22. Detent balls 58 locate within detent apertures 57 to hold the cover member 23 in one of two positions. This is to position the cut out 31 in relation to the head 30 of the retainer 24 to either arrest movement of the retainer 24 or to allow movement to a predetermined extent.

Figure groups 4 to 7 show the engagement of the overshot tool 10 with an inner tube assembly. The Figures show a head assembly 47 and do not include the inner tube in which the sample is collected. The inner tube is threadably connected to an end of the head assembly 47. The head assembly 47 combined with the inner tube is referred to as the inner tube assembly.

Figure 4A:
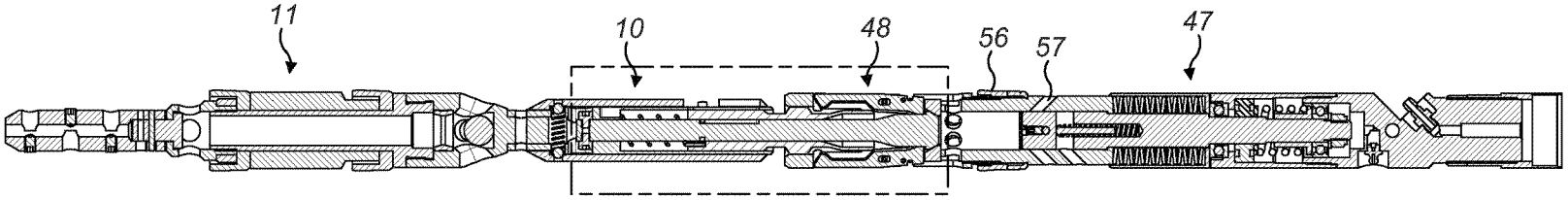
FIGS. 4*a*, 4*b*, 5*a*, 5*b* and 5*c* show cross-section views of an overshot tool an valve housing engaging and retrieving an inner tube assembly.
Figure 4C:
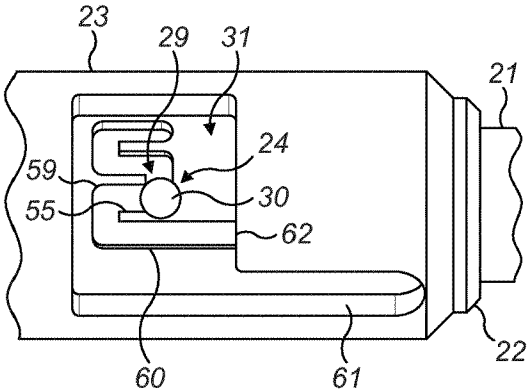
FIGS. 4*c* and 5*d* shows a part view of the overshot tool and the operation of the retainer mechanism.
Figure 4B:
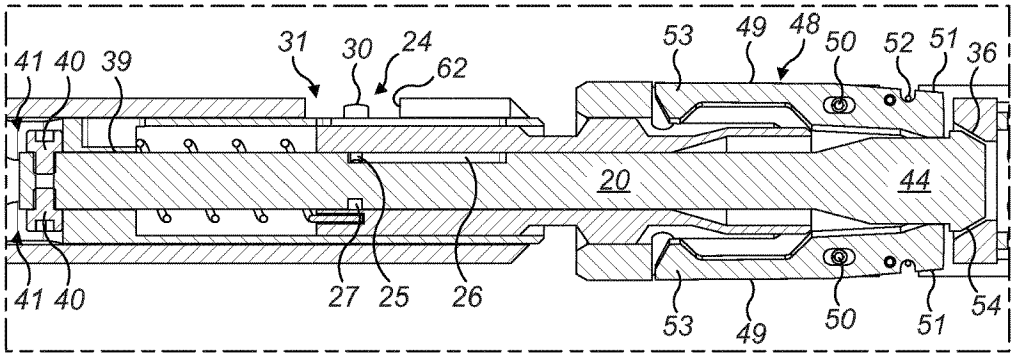

FIGS. 4*a* and 4*b* show the overshot tool 10 that has been pumped into a hole and has just engaged with the latches 48 of the head assembly. The latches 48 comprise a pair of arms 49 that are pivotally connected to the head assembly 47 via pivots 50. The inner ends 51 of the latch arms 49 locate behind the ledge 37 on the spike 20. An elastomeric o-ring 52 locates around the inner ends 51 and bias the inner ends 51 so that they engage against the head portion 44 of the spike 20. This holds the inner ends against the ledge 37 to thereby hold the latch 48 in a closed position with respect to the spike 20. The arms 49 have upper ends 53 which abut with the locking coupling of a drill string (not drawn) to hold the head assembly 47, in its drilling position where it is positioned to receive core sample as drilling progresses. In order for the upper ends 53 of the latch 48 to engage with locking coupling in the core barrel, the upper ends 53 need to project radially outward to a greater extent than what is shown in FIG. 4*b*. The diameter of the head portion 44 of the spike 20 is sized so that the inner end 51 are pushed outwardly against the O ring 52 to thereby retract the upper ends 53 to the position shown in FIG. 4*b*. This retracted position of the upper ends 53 provides clearance both with respect to the locking coupling and the inner wall of the drill tubing.

The example shown in FIGS. 4*a*, 4*b*, 4*c*, 5*a*, 5*b*, 5*c* and 5*d* are where the overshot tool 10 is required to be pumped into position which may be the case in respect of a wet hole where a column of water is maintained within the drill tube. It may also be the case in respect of a horizontal or upwardly inclined hole. Generally, it is required in a hole that is not sufficiently vertical (in the downward direction) to allow free fall of the inner tube assembly and associated overshot assembly.

FIG. 4*c* illustrates the setting of the cover member 23 for retrieval. FIGS. 4*a* and 4*b* show the overshot tool 10 just as it connects to the head assembly 47 that is to be retrieved. The tip 35 of the spike 20 pushes through the inner ends 51 of the arms 49 to thereby unlatch the head assembly 47 from the locking coupling of the core barrel. The latch 48 is now engaged with the spike 20 with the inner ends 51 of the arms 49 located behind the ledge 37.

Prior to sending the overshot tool 10 into the drill tube to retrieve the head assembly 47 the latch control means 21 is positioned with respect to the housing 22 so that the retainer 24 is in the position shown in FIG. 4*c*. In addition, the cover member 23 is rotated so that a slot 61 in the cover member 23 is not aligned with the slot 60 of the control slot 29. This is a pre-loaded position so that the spring 32 holds the retainer 24 in this position. When the spike 20 engages with the latch 48 the fluid pressure continues to act on the valve housing 11 and there is simultaneous operation of both the indicator valve 13 and the retainer 24 associated with the latch control means 21. Both of these things occur substantially simultaneously.

In the case of the indicator valve 13, the pressure will be sufficient to force the ball 14 through the valve seat 17 to the position shown in 4*a*, 3*b* and 3*c*. The valve seat 17 is a polymer and is sufficiently resilient to enable movement of the ball 14 at a predetermined pressure. This release of the ball 14 opens the fluid ports 15 which will enable fluid to flow through the valve housing 11. The valve arrangements within the head assembly 47 will be closed which will prevent fluid flow and allow the overshot tool 10 and valve housing 11 to be pumped through the drill string. Upon reaching a halt, the ball 14 moves through the valve seat 17 and causes a momentary pressure spike which provides an indication to the operator at the surface that the overshot tool 10 has landed.

Figure 5A:
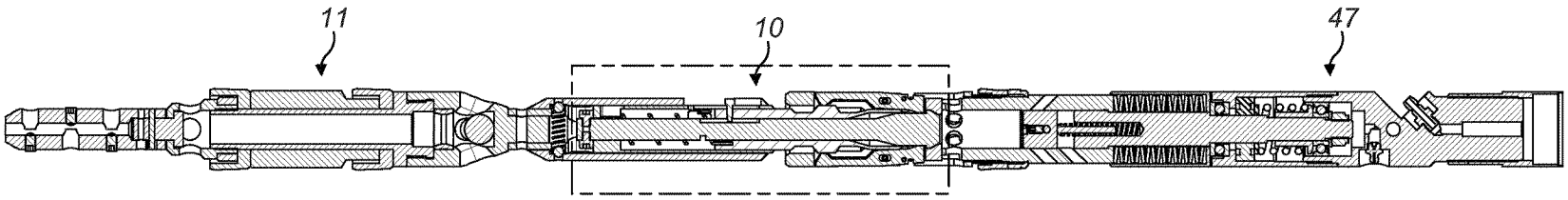
Figure 5B:
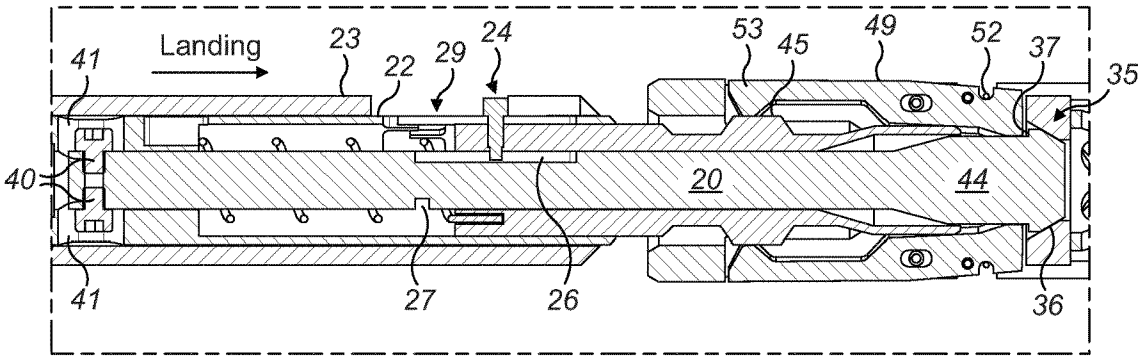
Figure 5C:
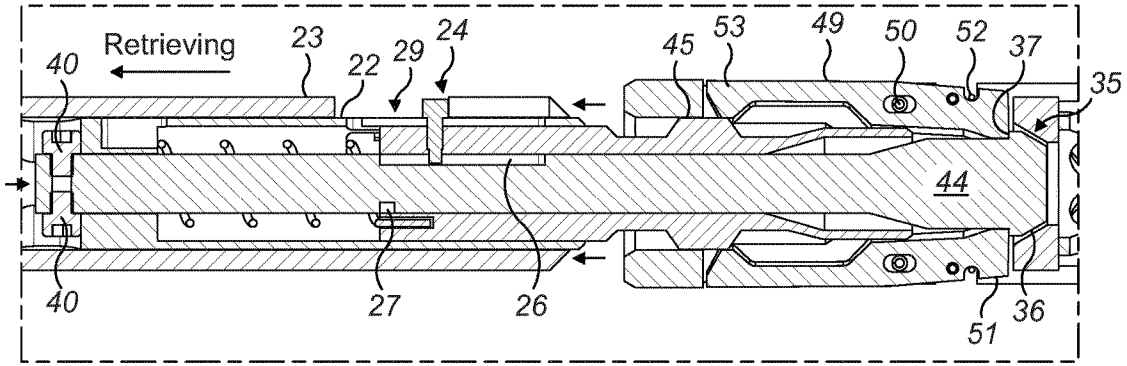
Figure 5D:
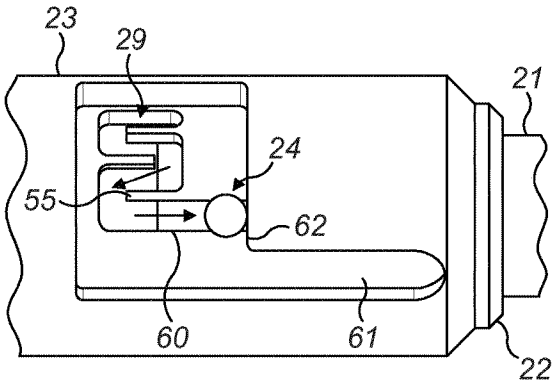

At the same time, the spike in fluid pressure results in the valve housing 11 pushing the housing 22 and cover member 23 forward towards the head assembly 47 so that the housing 22 is caused to move in relation to both the latch control means 21 and spike 20. Engagement of the end 25 of the retainer 24 within the circumferential slot 27 results in the spike 20 and latch control means 21 moving rearwardly as is shown in FIG. 5*d*. This in turn causes the spring 32 to be compressed and for the retainer 24 to be moved rearwardly in relation to the control slot 29. It reaches the end of edge end 55 of the control slot 29 and the torsional force exerted by spring 32 causes the latch control means 21 to rotate so that retainer 24 moves into slot portion 60. This is illustrated in FIG. 5*d* where the latch control means 21 is now able to move longitudinally with respect of spike 20 as a result of the end 25 now engaging the longitudinal slot 26. This moves the latch control means 21 to the positions shown in FIG. 5*b* where the abutment collar 45 blocks any further inward movement of the upper ends 53 of the latch arms 49. This is the intermediate position of the latch control means 21 and physically prevents any movement of the outer ends of the latch 53 inwardly and thereby prevents any disengagement of the inner ends 51 of the latch arms 49 from the tip 35 of the spike 20.

Once the latch control means 21 rotates so that the retainer 24 is within slot 60 of the control slot 29, the spring 32 acts to push the latch control means 21 forward and the retainer 24 slides within slot 60 until it abuts against edge 62 of the cut out 31 in the cover member 23. This is illustrated in FIG. 5*d*. In this position, the spring 32 continues to apply force to the latch control means 21 so as to hold the retainer 24 against the edge 62.

Figure 6A:
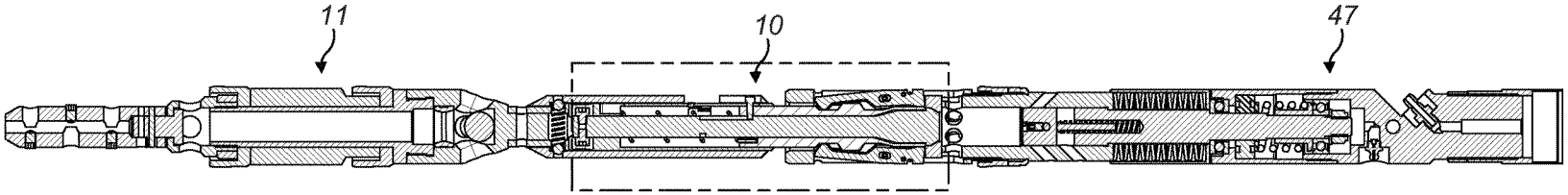
FIGS. 6*a* and 6*b* show cross-section views of an overshot tool and valve housing and show the overshot tool releasing from the latches of an inner tube assembly.
Figure 6C:
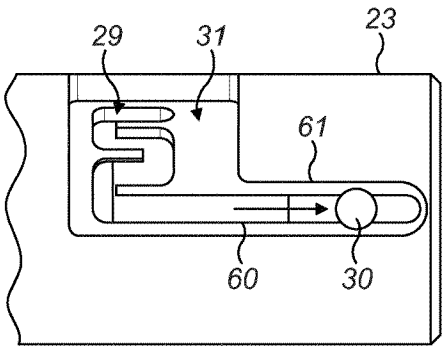
FIG. 6*c* shows a part view of an overshot tool and the operation of the release mechanism.
Figure 6B:
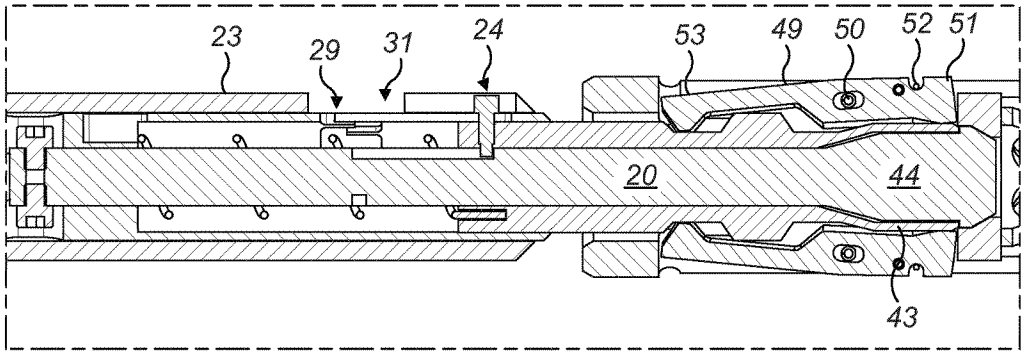
Figure 7A:
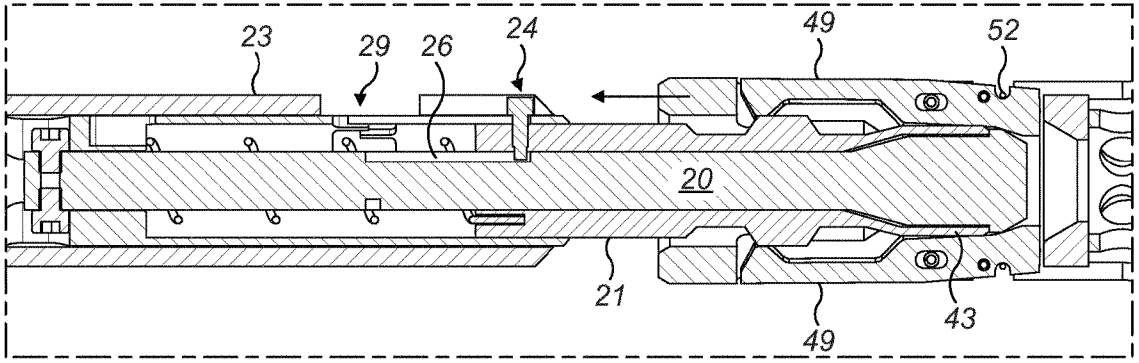
FIGS. 7*a*, 7*b*, 7*c* and 7*d* show a sequence of the overshot tool releasing from the latch in the core barrel head assembly.
Figure 7B:
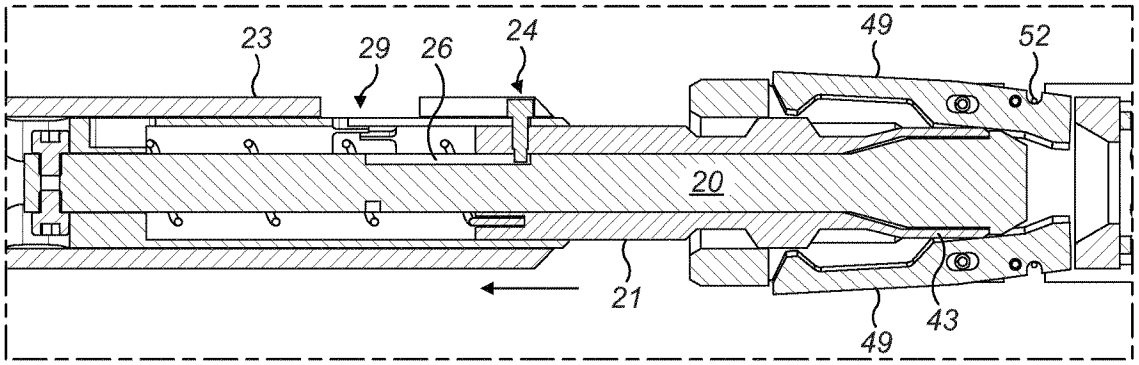
Figure 7C:
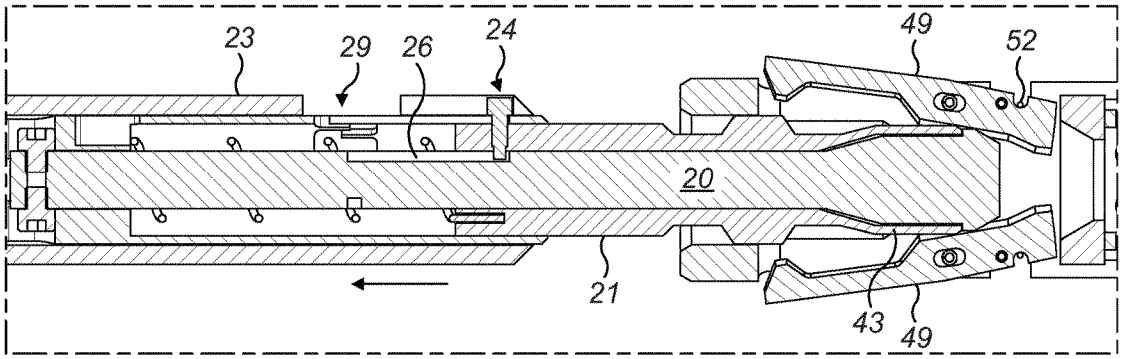
Figure 7D:
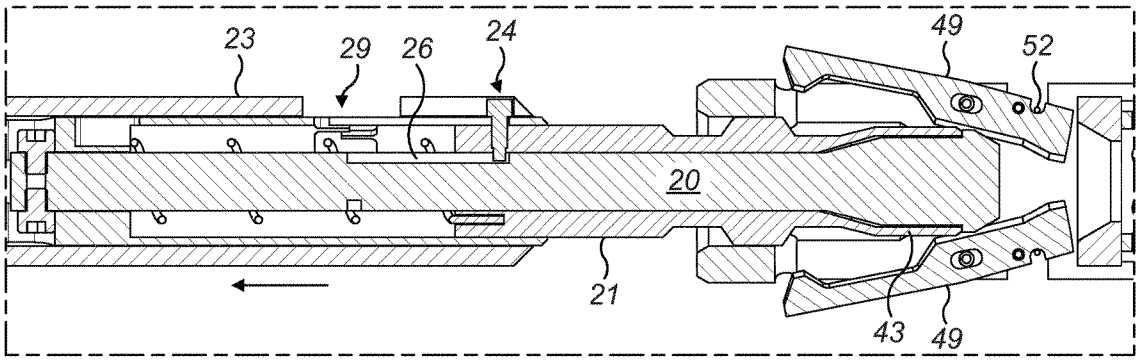

The release of the indicator valve 13 provides an indication to the driller at the surface that the overshot tool 10 has engaged the head assembly 47. As the latch control means 21 will have operated automatically, then the combination of the overshot tool 10, valve housing 11 and inner tube assembly will be ready for removal. In order to release the overshot tool 10 from the head assembly 47 upon arrival of the combination of the overshot tool 10, valve housing 11 and inner tube assembly to the surface, the cover member 23 is rotated so that the slot 61 and the cover member 23 aligns with slot 60 in the housing 22. This results in spring 32 pushing the latch control means 21 fully forward to its second position where it disengages the spike 20 from the latch as previously described above. The rotation of the cover member 23 is illustrated in FIG. 6*c* and the release position is shown in FIGS. 6*a* and 6*b*.

This allows a very convenient and safe release of the overshot tool 10 from the head assembly 47. This release is illustrated progressively in FIGS. 7*a*, 7*b*, 7*c* and 7*d* where the bell portion 43 of the latch control means 21 locates over the head portion 44 of the spike 20 such that the end of the bell portion 43 abuts against the ledge 37. In this position, the outer surface of the bell portion 43 abuts against the inner surfaces of the latch arms 49 adjacent the inner ends 51 of the latch arms 49 so that the inner ends 51 move away from the head portion 44 and out of engagement with the ledge 37. Once the inner ends 51 of the arms 49 no longer engage the ledge 37 then as seen in FIGS. 7*a*, 7*b*, 7*c* and 7*d*, the overshot tool 10 can be withdrawn from the latch 48 and the end of the head assembly 47.

Figure 9:
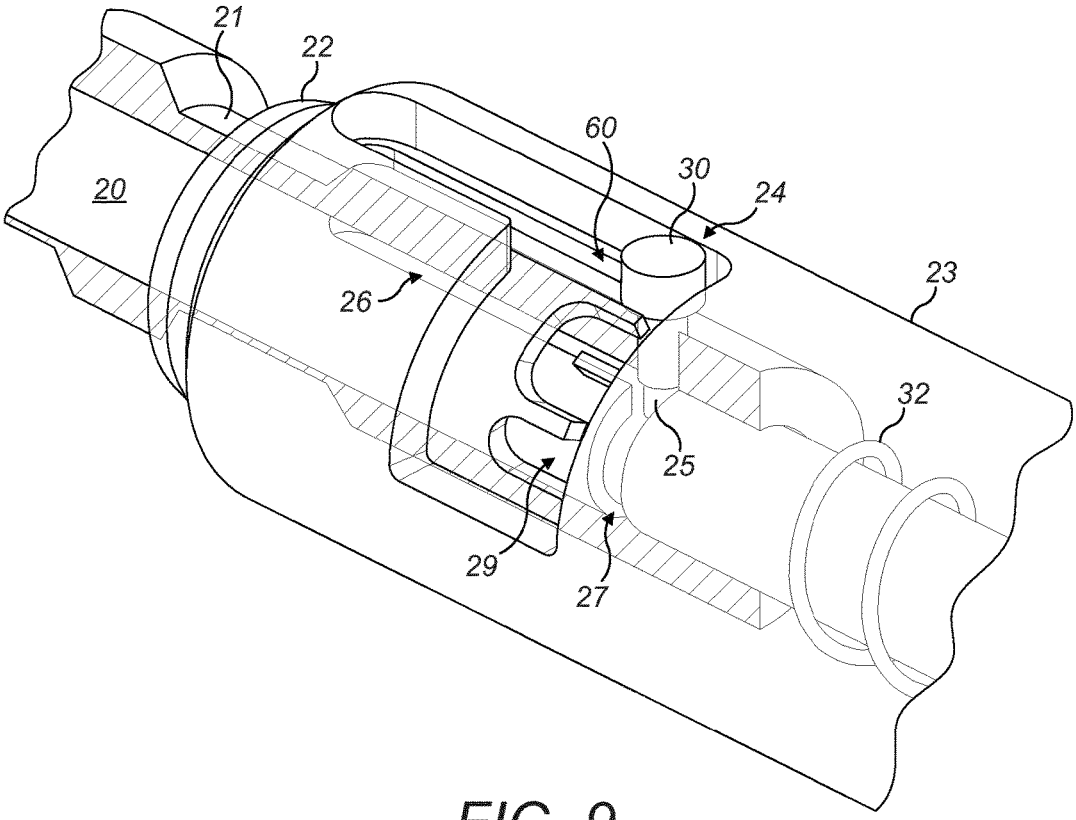

FIGS. 8 and 9 show more clearly the relationship of the longitudinal slot 26, circumferential slot 27 and retainer 24. As can been seen in, for example, FIG. 12*c*, when the retainer 24 is located in the three shorter lengths of the control slot 29, that are parallel and proceed slot 60 that cause back and forth movement of the retainer 24 portion of the control slot 29, the end 25 of the retainer 24 will be in the circumferential slot 27 and thereby lock movement of the latch control means 21 with respect to the spike 20. However, when the retainer moves into slot 60 out of the three shorter lengths of the control slot 29 (as shown in FIG. 9), then the end 25 aligns with the longitudinal slot 26 which then frees the latch control means 21 to move longitudinally with respect of the spike 20. This enables the latch control means 21 to move between its first and second position and also an intermediate position as will be described below.

Figure 10A:
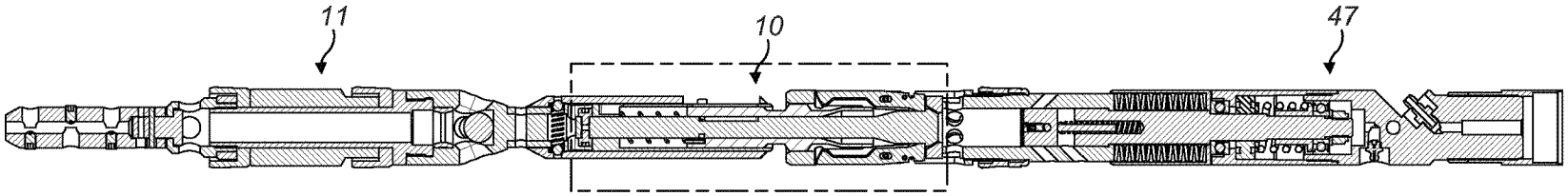
FIGS. 10*a* and 10*b* show cross-section views of an overshot tool and valve housing assembly engaged with an inner tube assembly to locate the inner tube assembly in a drill string.
Figure 10B:
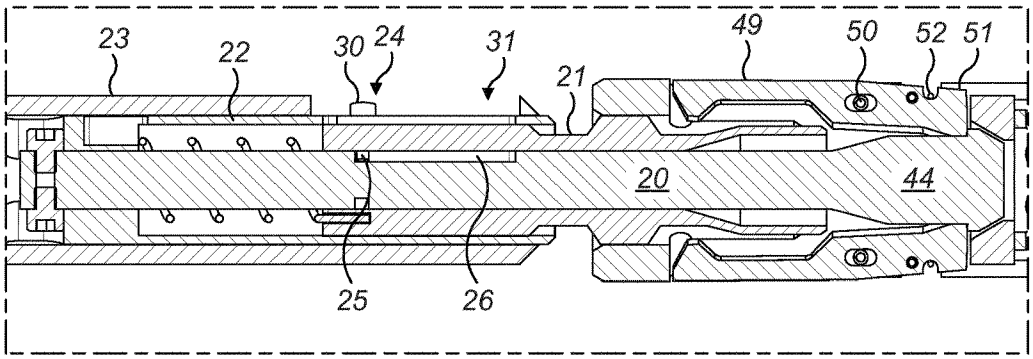

It may also be possible to use the overshot tool 10 and valve housing 11 to connect to an inner tube assembly at the surface and then pump this combination through the drill string. This is not necessary in general practice, but is possible with the overshot tool 10 connected to the head assembly 47 as shown in FIGS. 10*a* and 10*b* it would be possible to deliver an inner tube assembly to the end of the drill rods if required. The part conical portion 36 bears against a surface 54 within the head assembly 47. This enables the overshot tool 10 to push against the head assembly 47 while the latch 48 prevents release of the overshot tool 10. In this position, the overshot tool 10 combined with the valve housing 11 could be used to pump the inner tube assembly into the end of the drill string. This is generally not required, as the inner tube assembly itself would normally, in certain types of holes, be pumped into the drilling position. But as explained below, this invention is capable of being used in this way.

Figure 10C:
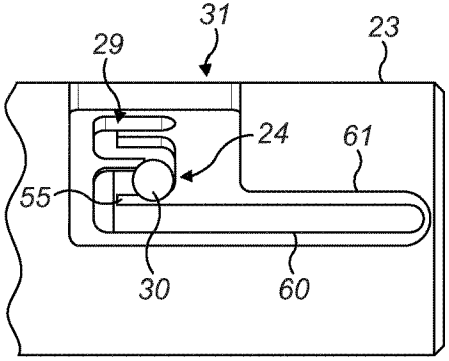
FIG. 10*c* is a part view of the overshot tool showing the retainer mechanism.

In order to achieve this, the retainer 24 is placed within the control slot 29 in the position shown in FIG. 10*c*. The retainer 24 is held in this position by the compressive action of spring 32 pushing the latch control means 21 with respect to the housing 22 to thereby hold the retainer 24 in the position shown in FIG. 10*c*. In addition, the end 25 of the retainer 24 is located within the circumferential slot 27 on the spike 20. This in turn forces the spike 20 forward so that the bolts 40 are in the forward portion of their slots 41. Further, the spring 32 provides a torsional load to the latch control means 21 which in turn means that the retainer 24 is pushed against the edge end 55 of the control slot 29.

In this configuration, the combination of the inner tube assembly, overshot tool and valve housing 11 can be inserted within the upper end of the drill tube and then pumped into place. In this case a stuffing box is located on the end of the drill tube which enables fluid to be pumped into the drill tube behind the valve housing 11. The stuffing box is designed to allow a wire rope connected to the wire rope connector 18 to be fed into the drill tube as the combination advances to the end of the drill tube.

The combination will eventually reach the position where the inner tube assembly will latch into its drilling position. Once the inner tube assembly stops moving, the fluid pressure behind the valve housing 11 will increase and exert pressure which will result in both operation of the indicator valve 13 in the valve housing 11 and forward movement of the housing 22 with respect to the spike 20. Both of these operations occur substantially simultaneously.

Figure 3B:
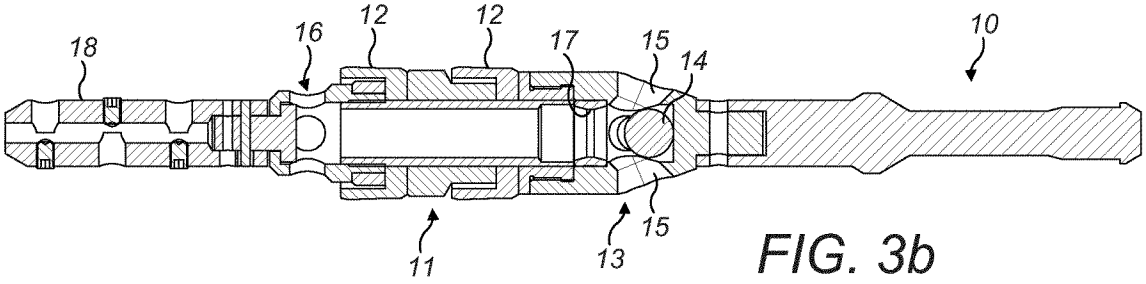
Figure 3C:
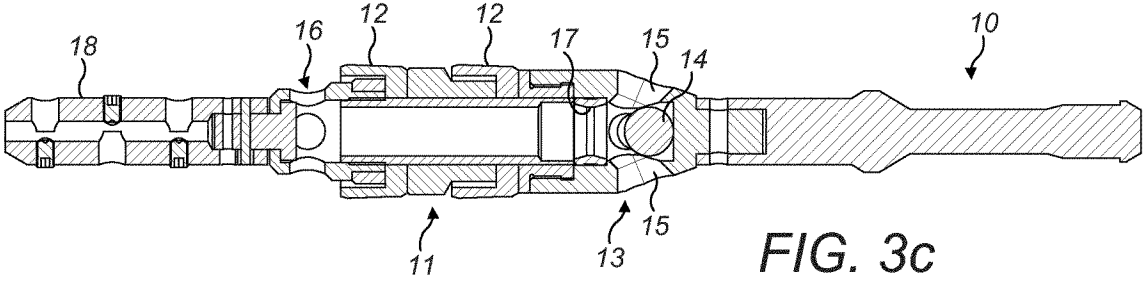

In relation to the indicator valve 13, the fluid pressure is sufficient to push the ball 14 through the valve seat 17 to thereby open the fluid flow ports 15 this is as previously described and illustrated in FIGS. 3*a*, 3*b* and 3*c*. At the same time, the housing 22 moves with respect of the spike 20. The spike 20 is in the position shown in FIG. 6*b*. In this position, the bolts 40 are at the upper ends of the slots 41. As the end 25 of the retainer 24 is located within the circumferential slot 27, then movement of the spike 20 also results in movement of the latch control means 21 which is effectively locked with respect to the spike 20. This causes movement of the retainer 24 so that the head abuts against the end 55 of the control slot 29. Once the retainer 24 reaches the end 55 of the control slot 29 the torsional force applied to the latch control means 21 by the spring 32 causes the latch control means 21 to rotate so that the retainer 24 locates within slot portion 60. In this position, the end 25 of the retainer 24 aligns with the longitudinal slot 26 in the spike 20 and allows the latch control means to slide forwardly with respect to the spike 20.

Once in the slot portion 60, the compressive force applied by spring 32 pushes the latch control means 21 forward and as the end 25 of the retainer 24 is in the longitudinal slot 26 and the head 30 locates within slot 61 of the cover member 23, then the latch control means 21 moves from its first position as shown in FIGS. 10*a* and 10*b* to a second position where the latch control means 21 acts to open the latch 48 to thereby release the spike 20 as previously described and with reference to FIGS. 7*a*, 7*b*, 7*c* and 7*d*. The overshot tool 10 and valve housing 11 are then free to be returned to the surface by winching in the wire which is connected to the wire rope connector 18. The core barrel assembly is now latched in position where the upper ends 53 of the arms 49 are now engaged with the locking coupling and thereby latch the inner tube assembly into place. With the overshot tool 10 released from the latch 48, then it is free to be returned to the surface.

Figure 11:
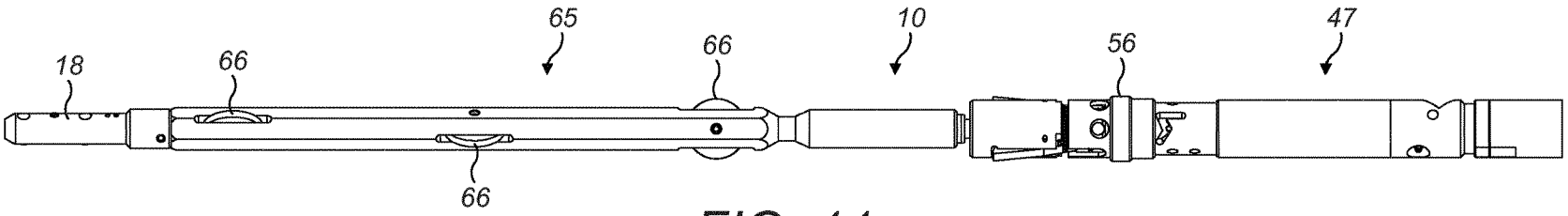
FIG. 11 shows a free fall assembly attached to an overshot tool with the overshot tool attached to a head assembly.

The overshot tool 10 may also be used for lowering an inner tube assembly into a dry hole where there is no fluid within the length of the drill tube or where the drill tube may only be partially filled. In this case, instead of using a valve housing 11 a free fall attachment 65 is connected to the overshot tool 10. This is illustrated in FIG. 11. The free fall attachment 65 has a series of guide rollers 66 that assist movement of the combination through the drill tube. Importantly, the weight of the free fall attachment 65 is sufficient to compress the spring 32. Accordingly, when the inner tube assembly latches in place, the weight of the free fall attachment 65 will cause movement of the housing 22 and cover member 23 with respect to the latch control means 21 and spike 20. However, while the combination of the free fall attachment 65, overshot tool 10 and inner tube assembly is suspended from the winch wire (attached to wire rope connector 18) there will be no relative movement between the housing 22 and the latch control means 21.

Figure 12A:
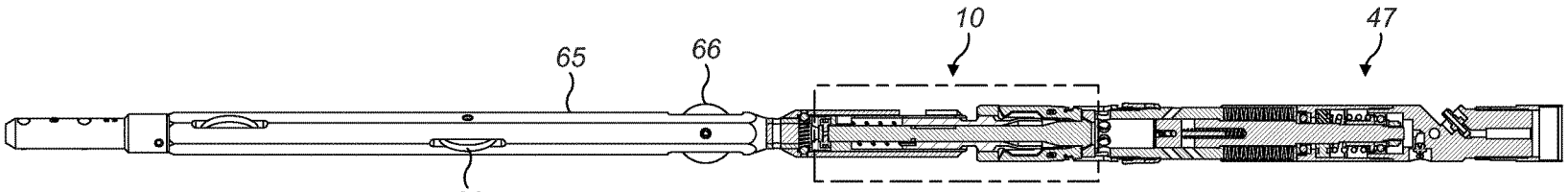
FIGS. 12*a* and 12*b* show the overshot tool connected to an inner tube assembly in preparation for delivery of the inner tube assembly to the core barrel of a drill string.
Figure 12C:
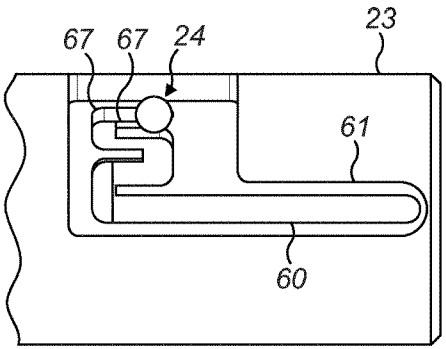
FIG. 12*c* shows a part view of the overshot tool and the position of the retainer mechanism for delivery of an inner tube assembly into a drill tube.
Figure 12B:
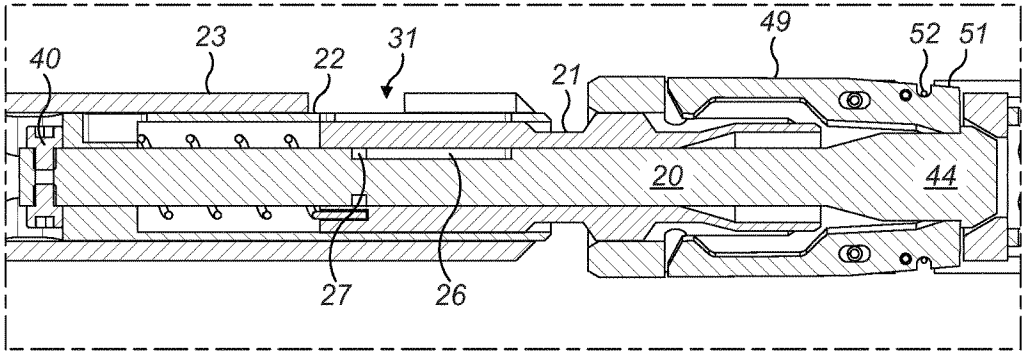

Prior to inserting the inner tube assembly into the drill tube, the position of the latch control means 21 is pre-set to the extreme end of the control slot 29 as shown in FIG. 12*c*. This position provides a degree of safety as it will require two separate operations to release the overshot tool 10 from the head assembly 47. This prevents accidental release of the overshot tool 10 in the case where the progress of the inner tube assembly through the drill tube is interrupted. Clearance between the landing seal 56 and the inner surface of the drill tube is not great and all that may be required to jam the progress of the inner tube assembly would be some deposits on the inner surface of the drill tube or some damage to the inner surface of the drill tube. If this occurs, then the full weight of the free fall attachment 65 will be applied to the overshot tool 10 which will result in the latch control means 21 indexing through the first section of the control slot 29. The first application of the weight of the free fall attachment 65 will result in the housing 22 moving downwardly which in turn results in the retainer 24 moving to end 67 of the control slot 29 as seen in FIG. 12*c*. Once in this position, the torsional force applied by spring 32 will result in the latch control means 21 rotating and bearing against end 67 of the control slot 29 as seen in FIG. 12*c*. Once the cessation of movement of the inner core assembly is sensed at the surface, the cable is winched in and the weight of the free fall attachment 65 is removed from the overshot tool 10. However, the retainer 24 goes to the position shown in FIG. 4*c* and the overshot tool 10 is not released from the head assembly 47. This then allows the driller to again lower the core barrel assembly in attempt to bypass the obstruction. If it does bypass the obstruction, then it can continue to its landing position at the end of the drill rods. However, if it again jams, then the weight of the free fall attachment 65 will act to release the overshot tool 10 from connection to the head assembly 47. In this case at least the overshot tool 10 and free fall attachment 65 can be recovered and then an attempt can be made to retrieve the inner tube assembly.

It is also possible that the inner tube assembly may be released from the overshot tool upon reaching water in a partially water filled hole. As the inner tube assembly with the attached overshot tool and free fall attachment 65 are lowered into the water, the movement of all of these components will be impeded. This will be sensed at the surface by the winch cable becoming slack.

At the same time, the weight of the free fall attachment 65 and overshot tool will operate the latch control by indexing it through the first section of the control slot 29. The inner tube assembly could now be released by a further tensioning of the cable and a subsequent release of the cable which in turn will result in the weight of the overshot tool 10 and free fall attachment 65 which will then result in release of the overshot tool from the inner tube assembly. The inner tube assembly will then be free to float to its latched position within the core barrel and while this is occurring, which will take some time, the operator can retrieve the overshot tool 10 by winching it out of the hole. This will obviously save some time as the overshot tool 10 may be out of the drill tube by the time the inner tube assembly latches into the core barrel.

Figure 13A:
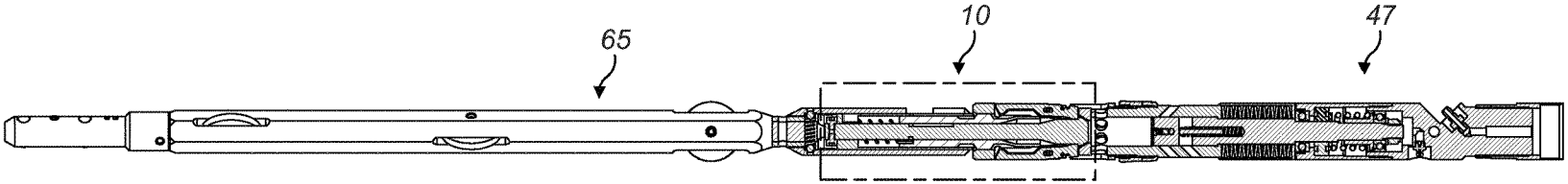
FIGS. 13*a* and 13*b* show the overshot tool as it relates to the position of the release member shown in FIG. 13*c*.
Figure 13C:
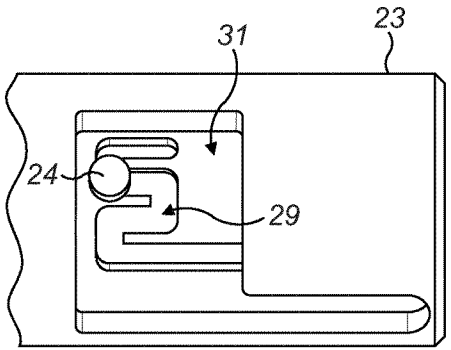
FIG. 13*c* shows a part view of the release mechanism part way through the operation of the release mechanism.
Figure 13B:
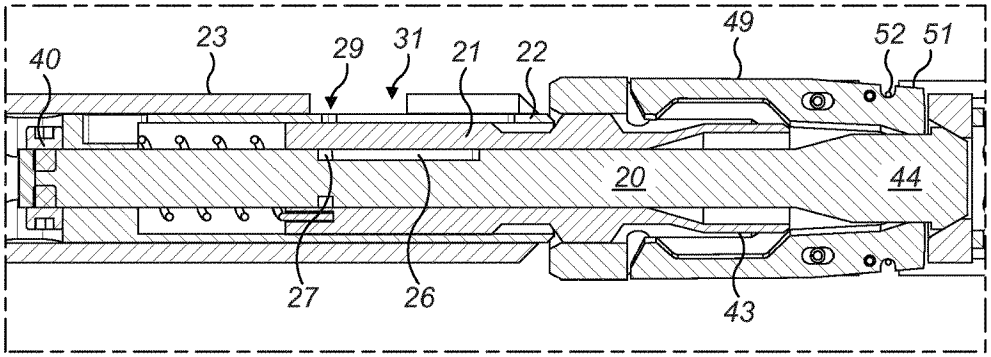
Figure 14A:
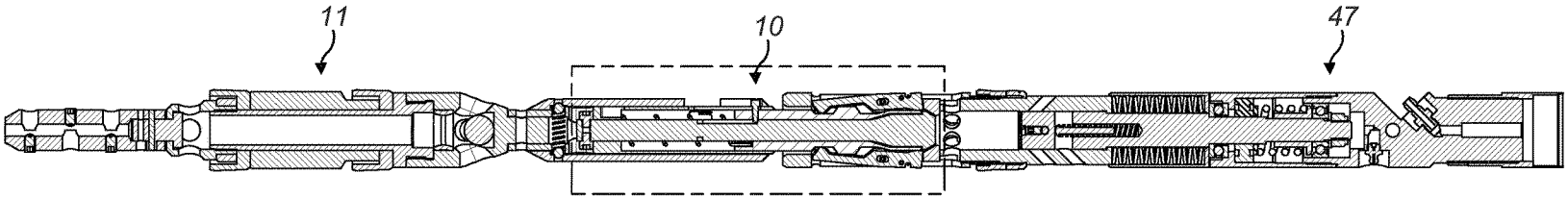
FIG. 14*c* shows the release mechanism in the position where the overshot tool is released from the core barrel head and FIGS. 14*a* and 14*b* show the overshot tool as it relates to the position of the release member shown in FIG. 14*c*.
Figure 14C:
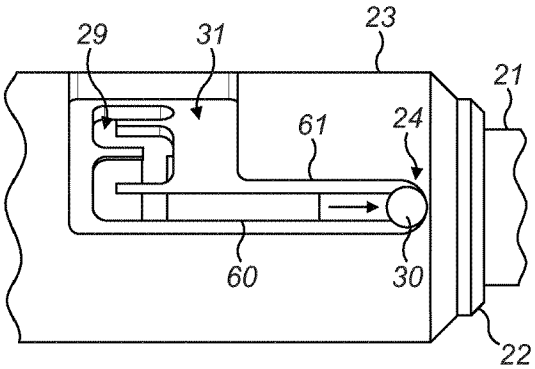
Figure 14B:
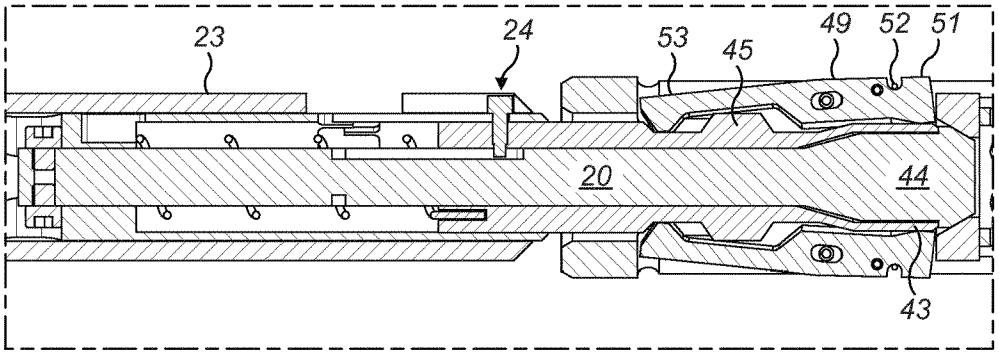

In a fully dry hole, the inner tube assembly will latch into drilling position with the latch control means 21 and retainer 24 in the position shown in FIG. 12*c*. Once in this position, then it will be necessary for the driller to lift the free fall attachment 65 and overshot tool 10 twice in order to release the overshot tool 10 from the latch 48 as the process of attachment will have resulted in the weight of the overshot tool 10 and free fall attachment 65 already indexing the retainer once as shown in FIG. 13*c*. This release is illustrated progressively in FIGS. 13*a*, 13*b* and 13*c* where FIG. 13*c* shows the retainer 24 located at the end of both slot 60 and 61 which results in the latch control means 21 moving to its second position as shown in FIG. 13*b* where it releases the overshot tool from the head assembly 47. This then allows the overshot tool 10 and free fall attachment 65 to be retrieved to the surface.

The free fall attachment 65 combined with the overshot tool 10 can also be used to lower an inner core assembly fully into a hole which is partially wet. In this case, the combination of the overshot tool 10, free fall attachment 65 and inner tube assembly will be lowered via the winch cable until the combination contacts the water within the drill tube. At this point, movement of the combination may be retarded by the water however it will still continue to fall under its own weight with the overshot tool 10 and free fall attachment 65 connected. Similarly, the weight of the free fall attachment 65 will be sufficient to operate the latch control means 21 and retainer 24 in the matter described above when the inner tube assembly reaches the core barrel.

As will be appreciated from the above description, the invention provides useful means of controlling the operation of an overshot tool 10 to both retrieve and deliver an inner tube assembly into and out of a core barrel. Further, the set of tools described above can be used both in relation to wet and dry holes and can also be used either in relation to pumping in or lowering under gravity.

This will be a significant advantage to drillers who prior to this invention were required to carry multiple sets of tools for either circumstance. This invention provides a unified set of tools which can be used in both applications.

It will be appreciated by those skilled in the art that the invention is not restricted in is use to the particular invention described. Neither is the present invention restricted in its preferred embodiment with regard to the particular elements and/or features described or depicted herein. It will be appreciated that the invention is not limited to the embodiment or embodiments disclosed, but is capable of numerous rearrangements, modification and substituents without departing from the scope of the invention.

The invention claimed is:

1. An overshot tool for releasable connection to a head assembly of a core barrel drilling apparatus, the tool comprising:

a primary engaging portion arranged to engage a latch of the head assembly to provide an axial couple between the tool and the head assembly;

a secondary engaging portion arranged to temporarily engage the latch in addition to the engagement of the latch by the primary engaging portion;

a retainer including a shaft and a head, the retainer acting between the primary engaging portion and the secondary engaging portion;

a housing having a region for engagement by the retainer, the primary engaging portion and the secondary engaging portion being axially movable relative to the housing, the retainer being configured i) to engage a first part of the region to releasably couple the primary and the secondary engaging portions for combined axial movement and ii) to engage a second part of the region to allow at least partial independent axial movement of the secondary engaging portion relative to the primary engaging portion, wherein by adjustment of a position of the retainer between the first part and the second part of the housing the tool is adjustable between a first mode to allow axial coupling between the tool and the head assembly and a second mode to provide a decoupling of the tool from the head assembly; and a bias member acting between the housing and the secondary engaging portion to bias the secondary engaging portion axially relative to the primary engaging portion, wherein the primary engaging portion includes an elongate shaft and the secondary engaging portion includes a sleeve positioned around the shaft, the sleeve being configured to slide axially over the shaft of the primary engaging portion.

2. The tool as claimed in claim 1, wherein the region of the housing includes a slot in which the first and the second parts of the housing include regions of the slot and the retainer is arranged to move within the slot between the first and the second parts.

3. The tool as claimed in claim 2, wherein the bias member is configured further to bias the secondary engaging portion rotatably relative to the primary engaging portion.

4. The tool as claimed in claim 3, wherein the bias member is a coil spring extending between the housing and the secondary engaging portion.

5. The tool as claimed in claim 1, further comprising a cover member to accommodate the primary and the secondary engaging portions and the housing, wherein the primary and the secondary engaging portions and the housing are arranged to slide axially within the cover member.

6. The tool as claimed in claim 5, further comprising a temporary rotational lock having at least two locking positions to temporarily lock the housing at the cover member at two rotational positions.

7. The tool as claimed in claim 5, wherein the cover member includes a cut-out positionable at the same axial and rotational position as the slot of the housing.

8. The tool as claimed in claim 2, wherein the retainer is fixed to and projects radially from the shaft and through the slot in the housing, wherein the bias member is configured to force rotational and axial movement of the retainer within the slot.

9. The tool as claimed in claim 8, wherein the first part at the slot extends in a circumferential direction to receive the retainer and the second part at the slot includes an axially extending length section being greater than a length section of the first part.

10. The tool as claimed in claim 1, wherein an engaging end of the primary engaging portion includes a bayonet configuration at a leading end of the tool engagable with the latch and an engaging end of the secondary engaging portion includes a bell portion arranged to engage the bayonet configuration in touching or near touching contact and to release the bayonet configuration from engagement with the latch.

11. The tool as claimed in claim 1, wherein the housing includes a coupling portion at a trailing end of the tool to mate with a valve housing or a free fall overshot attachment, the coupling portion capable of sliding axially within the housing and independently of an axial movement of the primary engaging portion.

12. The tool as claimed in claim 1, wherein the shaft includes a channel recessed into a radially outward facing surface of the shaft, the channel having a first part aligned axially with the shaft and a second part extending circumferentially around the shaft, a radially inner part of the retainer being configured for slidable engagement within the first and second parts of the channel.

13. A method of core drilling using an overshot tool forming part of a core barrel drilling apparatus, the method comprising:

transporting the overshot tool in an axially forward direction through the core barrel apparatus;

engaging a latch of a head assembly of the core barrel drilling apparatus via a primary engaging portion of the tool to decouple the head assembly from a fixed axial position at the core barrel apparatus and to axially couple the tool to the head assembly;

transporting the coupled tool and the head assembly in an axially rearward direction through the core barrel drilling apparatus to retrieve the head assembly; and releasing the axial couple between the tool and the head assembly by moving axially a secondary engaging portion to contact the latch and releasing engagement between the primary engaging portion and the latch, wherein the tool comprises:

the primary engaging portion, which is arranged to engage the latch of the head assembly to provide the axial couple between the tool and the head assembly;

the secondary engaging portion, which is arranged to temporarily engage the latch in addition to the engagement of the latch by the primary engaging portion;

a retainer including a shaft and a head, the retainer being arranged to act between the primary engaging portion and the secondary engaging portion;

a housing having a region for engagement by the retainer, the primary engaging portion and the secondary engaging portion being axially movable relative to the housing and the retainer being configured to engage a first part of the region to releasably couple the primary and the secondary engaging portions for combined axial movement and the retainer being configured to engage a second part of the region to allow at least partial independent axial movement of the secondary engaging portion relative to the primary engaging portion, wherein by adjustment of a position of the retainer between the first part and the second part of the housing the tool is adjustable between a first mode to allow axial coupling between the tool and the head assembly and a second mode to provide a decoupling of the tool from the head assembly; and a bias member acting between the housing and the secondary engaging portion to bias the secondary engaging portion axially relative to the primary engaging portion, wherein the primary engaging portion includes an elongate shaft and the secondary engaging portion includes a sleeve positioned around the shaft, the sleeve being configured to slide axially over the shaft of the primary engaging portion.

* * * * *